US009021666B2

(12) United States Patent
Sedivy

(10) Patent No.: US 9,021,666 B2
(45) Date of Patent: May 5, 2015

(54) FLASH GRIP SYSTEMS

(71) Applicant: Patricia J. Sedivy, Andover, NJ (US)

(72) Inventor: Patricia J. Sedivy, Andover, NJ (US)

( * ) Notice: Subject to any disclaimer, the term of this patent is extended or adjusted under 35 U.S.C. 154(b) by 0 days.

(21) Appl. No.: 13/785,665

(22) Filed: Mar. 5, 2013

(65) Prior Publication Data

US 2013/0255039 A1 Oct. 3, 2013

Related U.S. Application Data

(60) Provisional application No. 61/686,315, filed on Apr. 3, 2012.

(51) Int. Cl.
*A44B 1/04* (2006.01)
*A45F 5/02* (2006.01)

(52) U.S. Cl.
CPC ..... *A45F 5/02* (2013.01)

(58) Field of Classification Search
USPC ..... 24/304, 306, 447, 448, 114.6, 638, 24/3.12; 70/456–458
See application file for complete search history.

(56) References Cited

U.S. PATENT DOCUMENTS

| | | | | |
|---|---|---|---|---|
| 6,089,060 | A * | 7/2000 | Steeley | 70/456 R |
| 6,427,293 | B1 * | 8/2002 | Bowes, Jr. | 24/304 |
| 6,471,064 | B2 * | 10/2002 | Gordon | 206/534 |
| 6,591,646 | B1 * | 7/2003 | Huang | 70/456 R |
| D522,519 | S | 6/2006 | Rubin et al. | |
| 7,152,279 | B2 * | 12/2006 | Elliott | 24/3.1 |
| 7,343,647 | B1 * | 3/2008 | Kinskey et al. | 24/3.13 |
| 7,500,858 | B2 | 3/2009 | Emerson | |
| 7,544,073 | B2 | 6/2009 | Nguyen et al. | |
| 7,630,204 | B2 | 12/2009 | Pomerantz | |
| 7,651,169 | B2 * | 1/2010 | Collins | 297/485 |
| 8,316,492 | B2 | 11/2012 | Barber | |
| 2002/0166212 | A1 * | 11/2002 | Pratl | 24/3.2 |
| 2012/0239836 | A1 | 9/2012 | Enayati | |
| 2012/0311827 | A1 * | 12/2012 | Wilson | 24/304 |

* cited by examiner

*Primary Examiner* — Victor Batson
*Assistant Examiner* — Matthew Sullivan

(57) ABSTRACT

Flash grip system is used to securely retain a USB flash drive or thumb drive and provide a comfortable, gripping surface. Further, the flash grip system may use an article-fastener such that the USB flash drive may be removably attached to a variety of articles (such as a keychain, a belt loop, a bag strap, etc). The holding surface may further include decorative indicia for decorating the USB flash drive.

20 Claims, 5 Drawing Sheets

FLASH GRIP SYSTEMS

CROSS-REFERENCE TO RELATED APPLICATION

The present application is related to and claims priority from prior provisional application Ser. No. 61/686,315, filed Apr. 3, 2012 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of USB holding devices and more specifically relates to a holding assembly for a USB flash/thumb drive.

2. Description of the Related Art

Today, USB flash drives are a popular and portable data storage device. A USB drive may be used in place of other storage mediums such as floppy disks, CDs, DVDs, zip drive disks, etc, and may conveniently fit in one's pocket. In most cases, the USB drive is a plug and play device that includes Flash memory for storing data and a USB connector for connecting to a host device. While these devices work well, they are limited in the operations that they can perform. These devices are only configured for storing and transporting stored data (similar to other portable storage mediums) and therefore they do not include processing components, batteries for powering the processing components, or a user interface that enable users to communicate with the processing components.

Due to growing use of flash drives and thumb drives in today's technology-fueled era, it is important that USB drives are conveniently accessible throughout the day. Often times, people forget to take their USB drive with them because it is not yet considered an essential item (such as a wallet, cell phone, keys). As such, people may often discover that a USB drive would be extremely handy in unanticipated situations. However, because it is quite easy to forget a USB drive since they are small, lightweight, and inexpensive, it is not uncommon to be without a USB drive when such an unanticipated situation arises.

Various attempts have been made to solve the above-mentioned problems such as those found in U.S. Pat. and Pub. Nos. 2012/0239836 to Babak Enayati; U.S. Pat. No. 8,316,492 to Launce R. Barber; U.S. Pat. No. 7,500,858 to Brandon Emerson et al; U.S. Pat. No. 7,630,204 to Itzhak Pomerantz; U.S. Pat. No. 7,544,073 to David Nguyen et al; and U.S. Pat. No. D522,519 to Bennett S. Rubin et al. This prior art is representative of flash drive grips having an attachment mechanism to a key ring. None of the above inventions and patents, taken either singly or in combination, is seen to describe the invention as claimed.

Ideally, a flash grip system should provide a retro-installable holding assembly for a USB flash/thumb drive which may comprise a grip having an article-fastening clip attached thereto so that the flash drive may be easily attached to a belt loop, purse strap, key chain, brief case, etc., for convenient accessibility. Thus, a need exists for a reliable flash grip system and to avoid the above-mentioned problems.

BRIEF SUMMARY OF THE INVENTION

In view of the foregoing disadvantages inherent in the known USB flash drive holding grip art, the present invention provides a novel flash grip system comprising a flash grip assembly which may include a rectangular gripping strip, a pair of USB drive attachers, and a clip fastener for clipping the rectangular gripping strip holding a USB drive to a separate article or object.

The general purpose of the present invention, which will be described subsequently in greater detail, is to provide a "FLASH GRIP" with carabiner snap hook key ring which allows a flash drive to be easily attached to a belt loop, purse strap, brief case, etc., for convenient accessibility. As an added feature, the sides may be trimmed for a "custom fit" to various sized USB thumb drives.

Flash grip systems are disclosed herein in a preferred embodiment comprising a flash grip assembly, which may comprise a rectangular strip with dimensions of approximately 1½" width by 4" height manufactured of a pliable material comprising a foam sheet or other suitable pliable material. The foam sheet may provide a cushiony, ergonomic surface. Further, the rectangular strip has a first-end, a mid-point, and a second-end. The flash grip assembly further comprises a first-attacher preferably comprising a first-adhesive, a second-attacher preferably comprising a second-adhesive, a first-eyelet and a second-eyelet, an article-fastener comprising a carabineer clip, and an article-fastener-securer comprising a loop.

Relationally, the first-end of the rectangular strip is connected to the mid-point, and the mid-point of the rectangular strip is connected to the second-end. The first-end comprises the first-attacher, and the second-end comprises the second-attacher. The first-eyelet and the second-eyelet each may comprise a through-hole. The first-eyelet and the second-eyelet may each comprise a ring about a perimeter of the through-holes for providing a buffer between the article-fastener-securer and the pliable (foam) material of the rectangular strip. Further, the first-eyelet is located between the first-end and the mid-point of the rectangular strip, and the second-eyelet is located between the second-end and the mid-point of the rectangular strip. The rectangular strip is foldable in half about the mid-point such that the first-eyelet and the second-eyelet line up evenly.

The article-fastener-securer may comprise a loop, which may pass through the first-eyelet and the second-eyelet when the rectangular strip is folded in half. The loop is interconnected to the article-fastener. The article-fastener is fastenable to a clippable-article, such as a keychain, a strap of a carrying bag, a brief case, a backpack, a belt loop, or the like.

In the preferred embodiment, the rectangular strip may or may not comprise at least one decoration. The decoration may comprise an adornment (such as a design, insignia, jewel, picture, etc). In use, the flash grip system decorates to personalize the USB flash drive, thereby protecting the USB flash drive from abrasive damage, and improves portability of the USB flash drive via the article-fastener of the flash grip assembly. As such the present invention is convenient to 'take along' and its design causes it to be remembered.

A method of use for a flash grip system is also disclosed herein and may comprise the steps of: removing an adhesive sheet from a first-attacher of a first-end of a rectangular strip; placing a USB flash drive on an adhesive surface of the first adhesive; removing the adhesive sheet from a second adhesive of a second-end of the rectangular strip; folding the rectangular strip in half along a mid-point and pressing firmly the second-end of the rectangular strip on the USB flash drive; and attaching the flash grip system to a clippable article via the article-fastener. The method of use may further comprise the optional step of customizing the size of the rectangular strip to best fit the USB flash drive.

The present invention holds significant improvements and serves as a flash grip system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, flash grip systems, constructed and operative according to the teachings of the present invention discussed herein.

The various embodiments of the present invention will hereinafter be described in conjunction with the appended drawings, wherein like designations denote like elements.

DETAILED DESCRIPTION

As discussed above, embodiments of the present invention relate to a flash grip system and more particularly to a retro-installable holding assembly for a USB flash/thumb drive which may comprise a grip having an article-fastening clip attached thereto so that the flash drive may be easily attached to a belt loop, purse strap, key chain, brief case, etc., for convenient accessibility.

Generally speaking, the flash grip system may comprise a "FLASH GRIP" with carabineer snap hook key ring which allows a flash drive to be easily attached to a belt loop, purse strap, brief case, etc., for convenient accessibility. As an added feature, the sides may be trimmed for a "custom fit" to various sized USB thumb drives.

Figure 1:
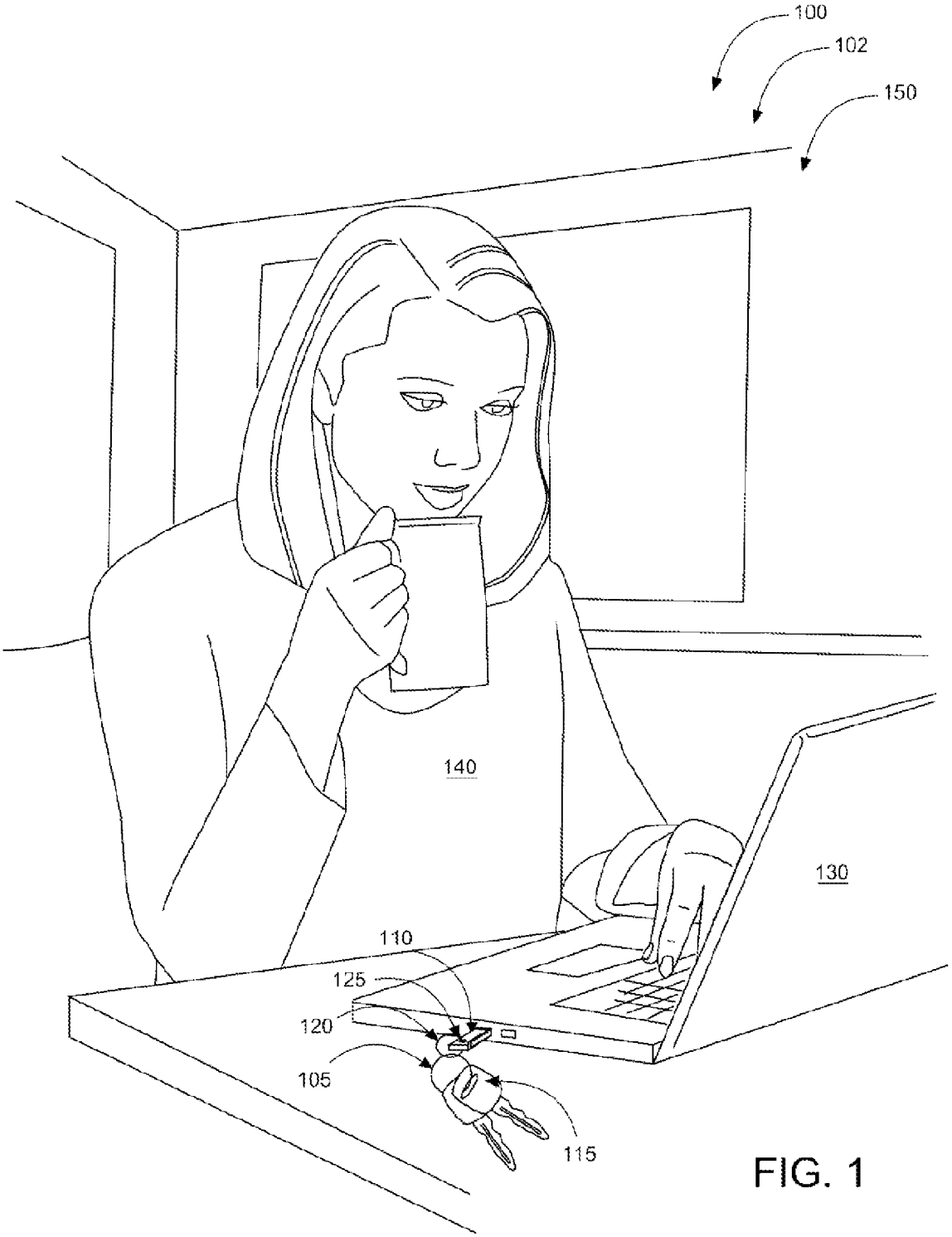
FIG. 1 shows a perspective view illustrating a user sitting at a desk using a computer showing a flash grip system in an 'in-use' condition holding a USB flash drive according to an embodiment of the present invention.

Referring now to the drawings by numerals of reference there is shown in FIG. 1, flash grip system 100 during 'in-use' condition 150 according to an embodiment of the present invention.

As shown, flash grip system 100 may comprise flash grip assembly 102. Flash grip assembly 102 may comprise rectangular strip 200 having first-end 202, mid-point 204, and second-end 206, first-attacher 225, second-attacher 230, first-eyelet 215, second-eyelet 220, article-fastener 120, and article-fastener-securer 125. Flash grip system 100 may be used to hold USB flash drive 110 such that USB flash drive 110 is fastenable to a clippable-article via article-fastener 120 of flash grip assembly 102. By way of example as illustration in FIG. 1, flash grip systems 100 during 'in-use' condition 150 may be used by user 140 to attach USB flash drive 110 to keychain 105 also holding keys 115. As shown, USB flash drive 110 may be inserted into a USB port on a computer, such as laptop 130, while USB flash drive 110 is still attached to keychain 105. In such a manner, user 140 has improved accessibility to USB flash drive 110 as it is conveniently available in keychain 105.

Figure 2A:
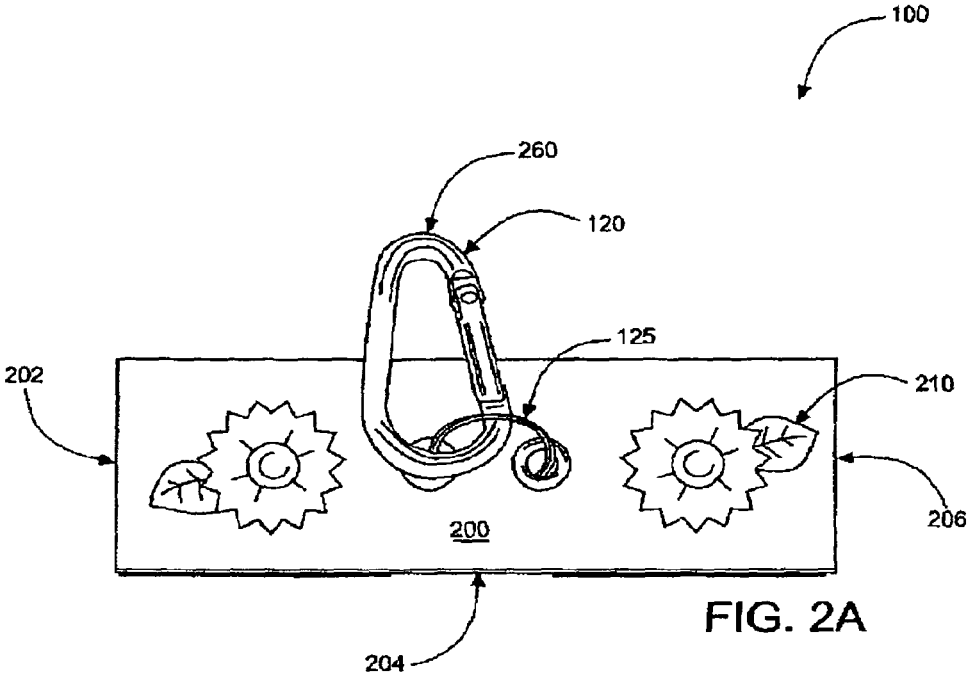
FIG. 2A is a perspective view of a top portion of the flash grip system comprising a rectangular strip having a carabineer clip according to an embodiment of the present invention of FIG. 1.

Referring now to FIG. 2A showing a perspective view of a top portion of flash grip systems 100 comprising rectangular strip 200 having carabineer clip 260 attached thereto according to an embodiment of the present invention of FIG. 1. As discussed, rectangular strip 200 comprises first-end 202, mid-point 204, and second-end 206. As shown in FIG. 2A, first-end 202 of rectangular strip 200 is connected to mid-point 204 and mid-point 204 is connected to second-end 206 of rectangular strip 200.

In continuing to refer to FIG. 2A, flash grip systems 100 may further comprise first-eyelet 215 and second-eyelet 220. First-eyelet 215 and second-eyelet 220 may each comprise a through-hole. Further, first-eyelet 215 and second-eyelet 220 may each comprise a ring around a perimeter of the through-holes thereby providing a buffer between article-fastener-securer 125 and rectangular strip 200.

Figure 2B:
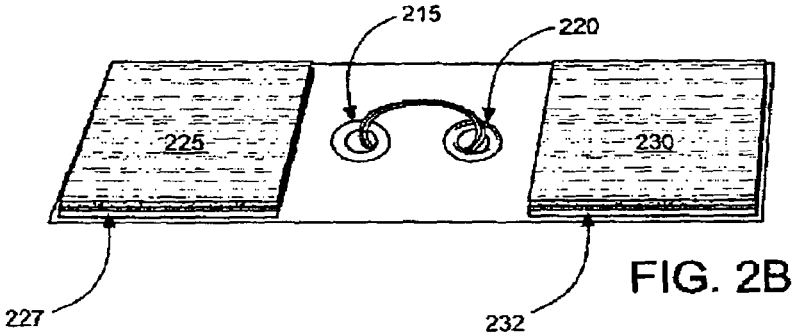
FIG. 2B is a perspective view a bottom portion of the flash grip system comprising a pair of adhesive-based fasteners for attaching the rectangular strip to the USB flash drive according to an embodiment of the present invention of FIG. 1.

First-eyelet 215 is located between first-end 202 and mid-point 204 of rectangular strip 200, and second-eyelet 220 is located between second-end 206 and mid-point 204 of rectangular strip 200. Preferably, first-eyelet 215 and second-eyelet 220 are orientated on rectangular strip 200 such that when rectangular strip 200 is folded in half about mid-point 204, the through-holes of first-eyelet 215 and second-eyelet 220 line up evenly, thereby enabling article-fastener-securer 125 to pass there-through. In one embodiment as shown in FIGS. 2A and 2B, article-fastener-securer 125 may comprise a loop. The loop of may pass through first-eyelet 215 and second-eyelet 220 when rectangular strip 200 is folded in half. Further, article-fastener-securer 125 is interconnected to article-fastener 120, and article-fastener 120 is fastenable to a clippable-article.

In a preferred embodiment, rectangular strip 200 may comprise dimensions of approximately 1½ inch width by 4 inches height. However, it should be appreciated that rectangular strip 200 may comprise smaller or larger dimensions to fit USB flash drive 110 of varying sizes. Rectangular strip 200 may be formed of a pliable material. In one embodiment, rectangular strip 200 may comprise a foam sheet. The foam sheet may provide a lightweight, cushiony, ergonomic surface for holding flash grip system 100. However, it should be noted that rectangular strip 200 may also be formed of leather, felt, vinyl, plastic, or a lightweight metal material.

In still referring to FIG. 2A, rectangular strip 200 may comprise decorative indicia 210. In one embodiment, decorative indicia 210 may comprise indicia such as a picture, an insignia, or the like. In other embodiments, decorative indicia 210 may comprise an adornment, such as a jewel, gem, or other artistic construction such that the present invention is more likely to be remembered for 'taking it along' when travelling. It should be appreciated that flash grip systems 100 decorates to personalize USB flash drive 110, protects USB flash drive 110 from abrasive damage, and improves portability of USB flash drive 110 via article-fastener 120 of flash grip assembly 102.

Referring now to FIG. 2B showing a perspective view of a bottom portion (inside in relation to the USB when attached thereto) of rectangular strip 200 according to an embodiment of the present invention of FIG. 1. As shown, first-end 202 of rectangular strip 200 comprises first-attacher 225 and second-end 206 of rectangular strip 200 comprises second-attacher 230. As may best be seen in FIG. 2B, first-attacher 225 may be fixedly attached to first-end 202 of rectangular strip 200 via first-attacher fastener 227 and second-attacher 230 may be fixedly attached to second-end 206 of rectangular strip 200 via second-attacher fastener 232. In one embodiment, first-attacher fastener 227 and second-attacher fastener 232 may each comprise hook-and-loop fasteners. In alternative embodiments, first-attacher fastener 227 and second-attacher fastener 232 may comprise a bonding substance (high-grade glue, adhesive, or the like).

In continuing to refer to FIG. 2B, article-fastener 120 of flash grip assembly 102 may comprise carabineer clip 260. Carabineer clip 260 may comprise a metal loop with a sprung gate used to quickly and reversibly connect components. This type of clip is useful for easily connecting and disconnecting clippable-articles to article-fastener 120. In other embodiments, article-fastener 120 may comprise a ring fastener, connectors, or the like.

Figures 3A, 3B, 3C, 3D:
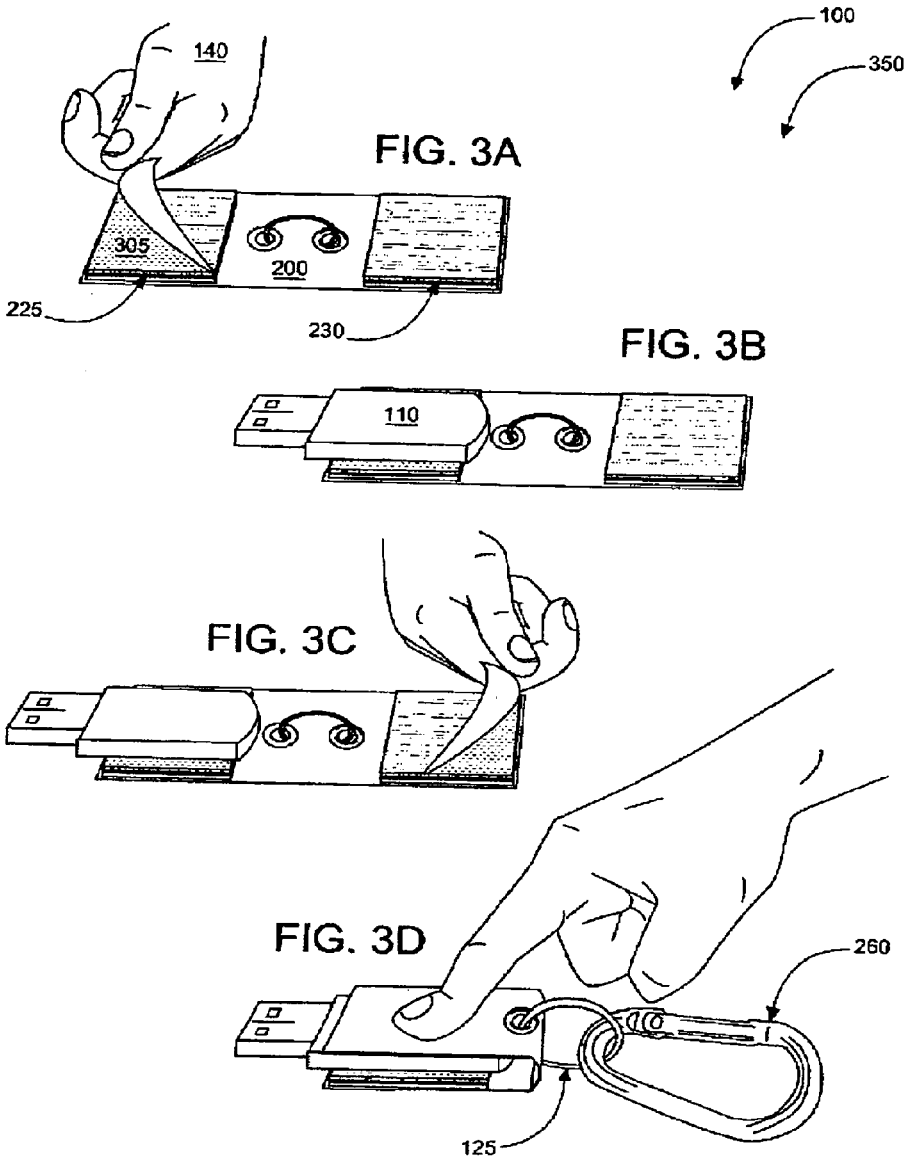
FIGS. 3A-3D are perspective views showing how the flash grip system may conveniently be applied to the USB flash drive according to an embodiment of the present invention of FIG. 1.

Referring now to FIGS. 3A-3D illustrating perspective views showing how the flash grip system 100 may conveniently be applied to USB flash drive 110 according to an embodiment of the present invention. As shown in FIG. 3A, user 140 may first peel off a top layer of first-attacher 225 of rectangular strip 200 revealing adhesive surface 305. As shown in FIG. 3B, user 140 may next place USB flash drive 110 in a middle area of adhesive surface 305 of first-attacher 225. It should be noted that USB flash drive 110 should be positioned such that the input port is facing outward from first-end 202 of rectangular strip 200. Next, as shown in FIG. 3C, user 140 may peel off a top layer of second-attacher 230 revealing adhesive surface 305. User 140 may then fold rectangular strip 200 constructed if a pliable material in half about mid-point 204 such that adhesive surface 305 of second-attacher 230 comes into contact with USB flash drive 110. Next, as shown in FIG. 3D, user 140 may apply a downward force onto second-end 206 of rectangular strip 200, thereby adhering adhesive surface 305 of first-attacher 225 and second-attacher 230 to USB flash drive 110.

Figure 4A:
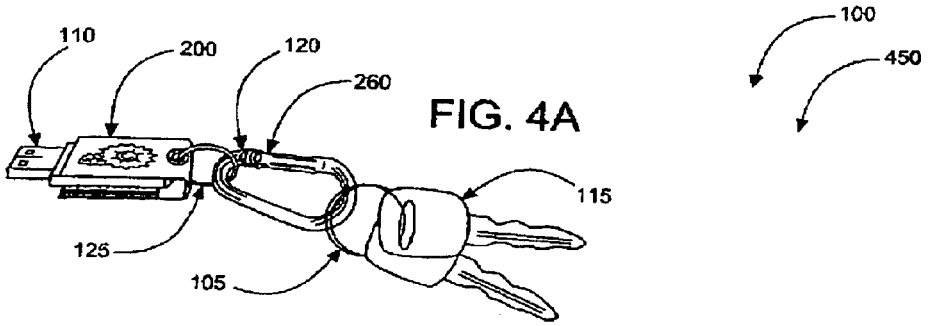
FIG. 4A is a perspective view illustrating the flash grip system used to attach the USB flash drive to a keychain according to an embodiment of the present invention of FIG. 1.

Referring now to FIG. 4A showing a perspective view illustrating flash grip systems 100 used to attach USB flash drive 110 to keychain 105 according to an embodiment of the present invention of FIG. 1. As shown, flash grip assembly 102 comprising rectangular strip 200 having decorative indicia 210 and retains USB flash drive 110 during 'in-use' condition 450 via first-attacher 225 and second-attacher 230. As shown, article-fastener 120 comprising carabineer clip 260 may attach to keychain 105 having a plurality of keys 115. In such a manner, USB flash drive 110 is taken whenever user 140 takes keychain 105 which likely has essential keys 115.

Figure 4B:
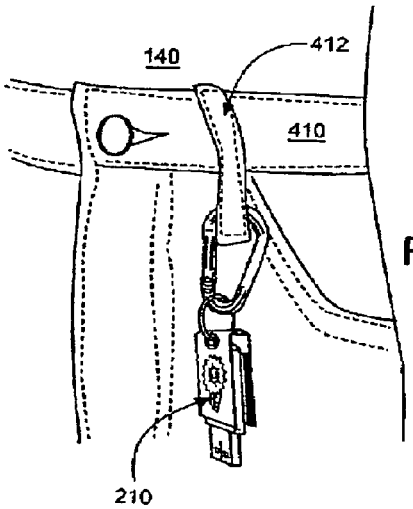
FIG. 4B is a perspective view illustrating the flash grip system used to attach the USB flash drive to a belt loop of a pair of pants according to an embodiment of the present invention of FIG. 1.

Referring now to FIG. 4B showing a perspective view illustrating flash grip systems 100 used to attach USB flash drive 110 to belt loop 412 of pants 410 worn by user 140 according to an embodiment of the present invention. As shown, clippable-article may comprise belt loop 412. In such a manner, article-fastener 120 comprising carabineer clip 260 may be removably fastenable to belt loop 412 of pants 410. As such, user 140 may comfortably and conveniently carry USB flash drive 110 attached to belt loop 412 for easy accessibility to USB flash drive 110 throughout the day.

Figure 4C:
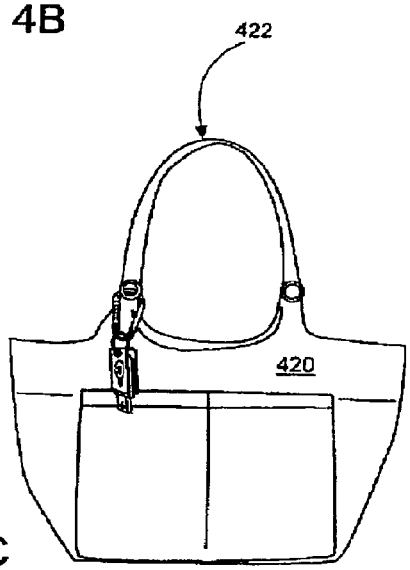
FIG. 4C is a perspective view illustrating the flash grip system used to attach the USB flash drive to a strap of a handbag according to an embodiment of the present invention of FIG. 1.

Referring now to FIG. 4C showing a perspective view illustrating flash grip systems 100 used to attach USB flash drive 110 to strap 422 of handbag 420 according to an embodiment of the present invention of FIG. 1. As shown, clippable-article may comprise strap 422 of handbag 420. It should be appreciated that strap 422 may also be a brief-case, luggage, backpack, carrying bag, or the like. In such a manner, article-fastener 120 comprising carabineer clip 260 may be removably fastenable to strap 422 of handbag 420 for convenient access to USB flash drive 110 throughout the day. A kit may comprise the present invention with an assortment of decorative indicia 210.

Figure 5:
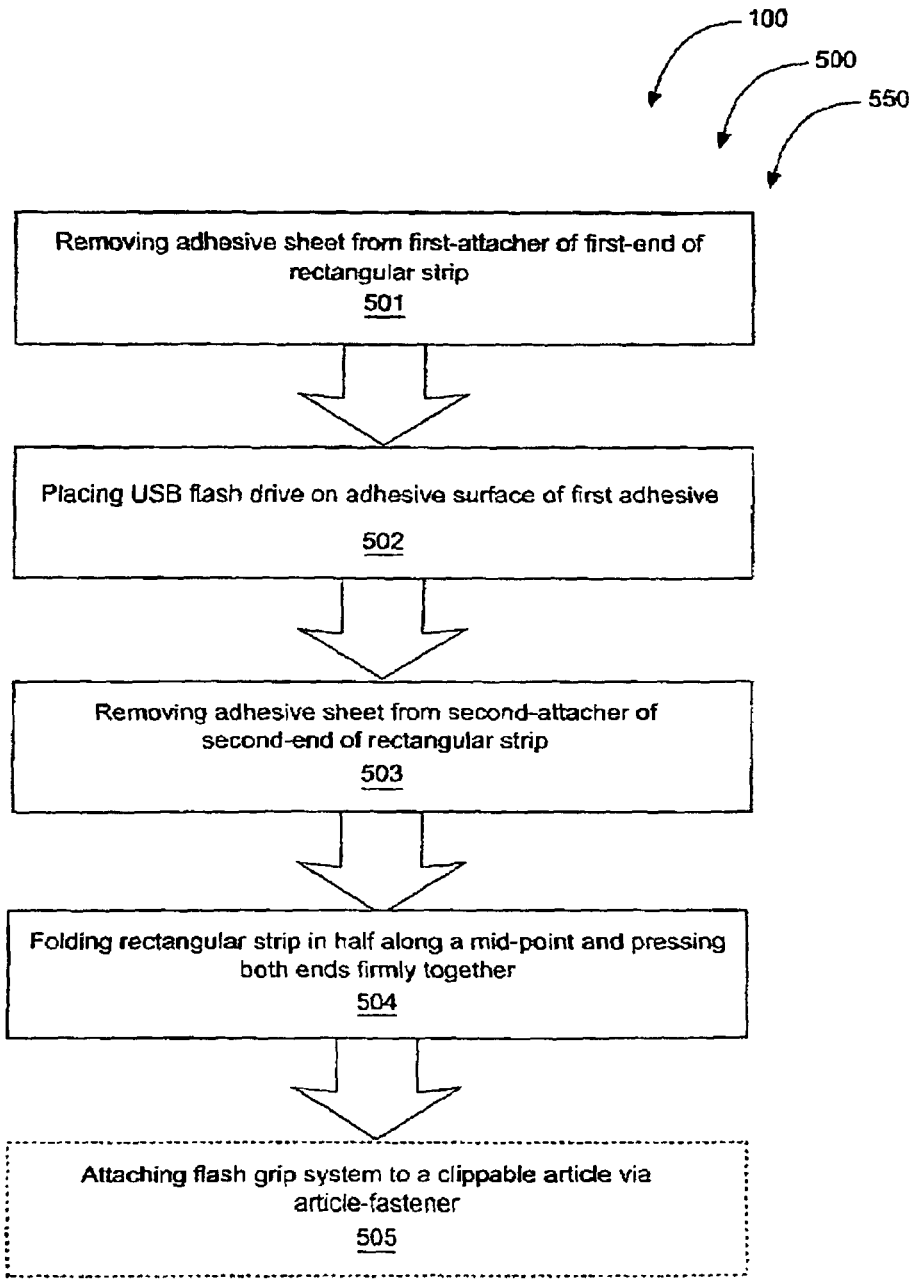
FIG. 5 is a flowchart illustrating a method of use of the flash grip system according to an embodiment of the present invention of FIGS. 1-4C.

Referring now to FIG. 5, showing flowchart 550 illustrating method of use 500 according to an embodiment of the present invention of FIGS. 1-4C. Method of use 500 for flash grip systems 100 may comprise the steps of: step one 501, removing an adhesive sheet from first-attacher 225 of first-end 202 of a rectangular strip 200; step two 502, placing USB flash drive 110 on adhesive surface 305 of first-attacher 225; step three 503, removing an adhesive sheet from second-attacher 230 of second-end 206 of rectangular strip 200; step four 504, folding rectangular strip 200 in half along mid-point 204 and pressing firmly second-end 206 of rectangular strip 200 on USB flash drive 110; and step five 505 attaching flash grip assembly 102 to a clippable article via article-fastener 120.

In continuing to refer to FIG. 5, method of use 500 may further comprise the optional step of customizing the size of rectangular strip 200. This may be accomplished by cutting the sides of rectangular strip 200 such that rectangular strip 200 does not overlay on USB flash drive 110.

It should be noted that the steps described in the method of use can be carried out in many different orders according to user preference. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A flash grip system for use with a USB flash drive comprising:

a flash grip assembly, said flash grip assembly comprising: a rectangular strip (200) having a first-end, a mid-point, and a second-end;

a first-attacher (225) positioned at the first end;

a second-attacher (230) positioned at the second end;

a first-eyelet (215) positioned on a longitudinal midline of the rectangular strip and offset from a transverse mid-line of the rectangular strip;

a second-eyelet (220) positioned on the longitudinal mid-line of the rectangular strip offset equidistantly from the transverse mid-line as the first-eyelet and opposite the first eyelet;

an article-fastener (120) comprising one of a carabineer or a ring fastener;

and an article-fastener-securer (125) comprising a loop;

wherein said first-eyelet and said second-eyelet comprises through-holes with rings about the perimeters of the through-holes;

wherein said rectangular strip is foldable in half about said transverse mid-line such that said first-eyelet and said second-eyelet line up evenly;

wherein said loop passes through said first-eyelet and said second-eyelet when said rectangular strip is folded in half;

wherein said loop is interconnected to said article-fastener;

wherein said article-fastener is fastenable to a clippable-article;

wherein said first-attacher and said second-attacher each comprise an adhesive surface for attachment to a USB flash drive;

wherein said rectangular strip further comprises decorative indicia;

and wherein said flash grip system decorates to personalize said USB flash drive, protects said USB flash drive from abrasive damage, and improves portability of said USB flash drive via said article-fastener of said flash grip assembly.

2. The flash grip system of claim 1 wherein said rectangular strip comprises dimensions of approximately 1½ inch width by 4 inches height.

3. The flash grip system of claim 2 wherein said rectangular strip comprises a pliable material.

4. The flash grip system of claim 3 wherein said rectangular strip comprising said pliable material comprises a foam sheet.

5. The flash grip system of claim 4 wherein said foam sheet provides cushiony ergonomic surface for holding said flash grip assembly.

6. The flash grip system of claim 5 wherein said first-attacher and said second-attacher each comprises an adhesive.

7. The flash grip system of claim 6 wherein said first-eyelet and said second-eyelet each comprise a ring about a perimeter of said through-holes thereby providing a buffer to said article-fastener-securer.

8. The flash grip system of claim 7 wherein said article-fastener comprises a carabineer clip.

9. The flash grip system of claim 7 wherein said article-fastener comprises a ring fastener.

10. The flash grip system of claim 8 wherein said rectangular strip comprises leather.

11. The flash grip system of claim 8 wherein said rectangular strip comprises felt.

12. The flash grip system of claim 8 wherein said rectangular strip comprises vinyl.

13. The flash grip system of claim 8 wherein said decoration comprises indicia.

14. The flash grip system of claim 8 wherein said decoration comprises an adornment.

15. The flash grip system of claim 1 wherein said clippable-article comprises a key ring of a key chain.

16. The flash grip system of claim 1 wherein said clippable-article comprises a belt loop of a pair of paints.

17. The flash grip system of claim 1 wherein said clippable-article comprises a strap of a carrying bag.

18. A flash grip system comprising:

a flash grip assembly comprising:

a rectangular strip comprising dimensions of approximately 1½" width by 4" height manufactured of pliable material comprising a foam sheet, said foam sheet providing a cushiony, ergonomic surface, said rectangular strip having a first-end, a mid-point, and a second-end;

a first-attacher comprising a first-adhesive;

a second-attacher comprising a second-adhesive;

a first-eyelet and a second-eyelet;

an article-fastener comprising a caribiner clip; and an article-fastener-securer comprising a loop;

wherein said first-end of said rectangular strip is connected to said mid-point;

wherein said mid-point of said rectangular strip is connected to said second-end;

wherein said first-end comprises said first-attacher;

wherein said second-end comprises said second-attacher;

wherein said first-eyelet and said second-eyelet comprises through-holes;

wherein said first-eyelet and said second-eyelet each comprise a ring about a perimeter of said through-holes thereby providing a buffer to said article-fastener-securer;

wherein said first-eyelet is located between said first-end and said mid-point of said rectangular strip;

wherein said second-eyelet is located between said second-end and said mid-point of said rectangular strip;

wherein said rectangular strip is foldable in half about said mid-point such that said first-eyelet and said second-eyelet line up evenly;

wherein said article-fastener-securer comprises a loop;

wherein said loop passes through said first-eyelet and said second-eyelet when said rectangular strip is foldable in half;

wherein said loop is interconnected to said article-fastener;

wherein said article-fastener is fastenable to a clippable-article;

wherein said rectangular strip further comprises at least one decoration, said at least one decoration comprising an adornment; and wherein said flash grip system decorates to personalize said USB flash drive, protects said USB flash drive from abrasive damage, and improves portability of said USB flash drive via said article-fastener of said flash grip assembly.

19. A method of use for a flash grip system comprising the steps of:

providing a flash grip system according to either claim 1 or claim 18;

removing an adhesive sheet from a first-attacher of a first-end of a rectangular strip;

placing a USB flash drive on an adhesive surface of said first adhesive;

removing said adhesive sheet from a second adhesive of a second-end of said rectangular strip; and folding said rectangular strip in half along a mid-point and pressing firmly said second-end of said rectangular strip on said USB flash drive.

20. The method of use of claim 19 further comprising the optional step of attaching said flash grip system to a clippable article via an article-fastener.

* * * * *